United States Patent [19]

Choy et al.

[11] Patent Number: 4,682,969

[45] Date of Patent: Jul. 28, 1987

[54] RECONFIGURABLE VEHICLE-ROBOT TOY

[75] Inventors: Terrence A. Choy, Redondo Beach; Harold A. Hartleben, Boyle Heights, both of Calif.

[73] Assignee: Mattel, Inc., Hawthorne, Calif.

[21] Appl. No.: 781,607

[22] Filed: Sep. 27, 1985

[51] Int. Cl.[4] ..... A63H 13/00; A63H 17/21

[52] U.S. Cl. ..... 446/279; 446/376; 446/440

[58] Field of Search ..... 446/268, 376, 487, 269, 446/275, 279, 280, 286, 289–292, 465, 440, 320, 310, 470, 433; D21/128, 131, 166, 136

[56] References Cited

U.S. PATENT DOCUMENTS

| | | | |
|---|---|---|---|
| D. 279,916 | 7/1985 | Obara | D21/136 |
| D. 281,001 | 10/1985 | Ohno | D21/136 |
| D. 281,087 | 10/1985 | Ohno | D21/136 |
| D. 281,088 | 10/1985 | Murakami | D21/150 |
| D. 283,717 | 5/1986 | Obara | D21/136 |
| 3,553,885 | 1/1971 | Tazaki . | |
| 4,167,830 | 9/1979 | Ogawa . | |
| 4,183,173 | 1/1980 | Ogawa . | |
| 4,206,564 | 6/1980 | Ogawa . | |
| 4,248,006 | 2/1981 | Jones et al. . | |
| 4,391,060 | 7/1983 | Nakane . | |
| 4,516,948 | 5/1985 | Obara | 446/376 X |
| 4,571,201 | 2/1986 | Matsuda | 446/85 |
| 4,571,203 | 2/1986 | Murakami | 446/487 X |
| 4,578,046 | 3/1986 | Ohno | 446/376 |
| 4,580,993 | 4/1986 | Ohno | 446/376 |
| 4,586,911 | 5/1986 | Murakami | 446/376 |

FOREIGN PATENT DOCUMENTS

| | | | |
|---|---|---|---|
| 2128489 | 5/1984 | United Kingdom | 446/376 |

*Primary Examiner*—Mickey Yu

*Attorney, Agent, or Firm*—Ron Goldman; Melvin A. Klein; Daniel F. Sullivan

[57] ABSTRACT

A toy for use in conjunction with a toy doll that can simulate both a robot and a vehicle is presented. The toy transforms from the configuration of a vehicle to that of a robot by rotating or moving upper and lower leg members with respect to each other until they are disposed in approximately a vertical position. A torso member rotatably coupled to the upper leg members simulates a robotic humanoid head and trunk. Side arms operably coupled to the torso member are adapted to either hang vertically simulating the arms of a robot or to be positioned adjacent the robot's head to simulate the front of a vehicle. When the side arms are disposed in the latter position, the toy can be folded into a compact configuration simulating a vehicle such as an all terrain vehicle. A toy doll can be placed on top of the toy when it simulates a vehicle and used in conjunction with handles extending from the side arms.

12 Claims, 6 Drawing Figures

RECONFIGURABLE VEHICLE-ROBOT TOY

BACKGROUND OF THE INVENTION

This invention relates generally to toy robots and toy vehicles and, more particularly, to a reconfigurable toy whose configuration can be changed or transformed so that the toy can be used as both a robot and a vehicle and can be used in conjunction with a toy doll when simulating a vehicle.

Various toys have been manufactured for children to play with as robots and vehicles. For example, U.S. Pat. No. 4,391,060 describes three separate vehicle toys which can be operated independently or fit together (reconfigured) to simulate a robot. U.S. Pat. No. 4,248,006 discloses a toy having upper and lower body sections. The lower body section is operably attached to the upper body section in a plurality of configurations. The toy assembly described in U.S. Pat. No. 4,183,173 has a rear wheel unit provided with a joint assembly for removably mounting a robot doll or toy airplane. Another toy is disclosed in U.S. Pat. No. 3,553,885. This toy has a power unit simulating a man, animal, etc. which is detachably mounted on a moving unit simulating a vehicle. In all of these patents, the different parts of the toys are removably fit together to form a desired configuration for the toy.

A toy made from different parts permanently coupled together which can be adjusted folded, rotated or moved with respect to each other to form different configurations is more desirable than the above described toys because the toy consists of one integral unit. Since the parts of such a transformable toy are permanently coupled together, the parts cannot be separated or taken apart, reducing the possibility that parts will be misplaced or lost. As such, a child can quickly change the configuration of such a toy (transform the toy) without taking the toy apart. Where the toy is transformable from a vehicle to a robot, additional play options are made available to the child if the toy may be used in conjunction with a toy doll. For example, a toy may be folded into the shape of a vehicle on which a toy doll may be positioned, placed or mounted. After the child has finished playing with the toy doll, the toy may be transformed into a robot for further use by the child. In the past, transformable toys have been manufactured which may be transformed from a vehicle to a robot. However, these toys are not intended to be used in conjunction with a toy doll.

The toy industry is constantly striving to create new toys which provide novel play options and appeal to the creative imagination of children playing with the toys. Accordingly, there is a need in the toy manufacturing arts for a reconfigurable (transformable) toy with integral adjustable parts capable of being adjusted, folded, rotated or moved with respect to each other to form different configurations (such as a robot or a vehicle) which can be used in conjunction with a toy doll.

SUMMARY OF THE INVENTION

It is an object of this invention to provide a reconfigurable toy which may be used to simulate both a vehicle and a robot.

It is another object of this invention to provide a reconfigurable toy with integral adjustable parts which can be adjusted, folded, rotated or moved with respect to each other to simulate both a vehicle and a robot by transforming the toy from a vehicle to a robot.

It is still another object of this invention to provide a reconfigurable toy which may be used in conjunction with a toy doll when simulating a vehicle.

These and other objects and advantages are attained by a toy which can be used in conjunction with a toy doll and to simulate both a robot and a vehicle. The toy transforms from the configuration of a vehicle to that of a robot by rotating or moving upper and lower leg members with respect to each other until they are disposed in approximately a vertical position. A torso member rotatably coupled to the upper leg members simulates a robotic humanoid head and trunk. Side arms operably coupled to the torso member are adapted to either hang vertically simulating the arms of a robot or to be positioned adjacent the robot's head to simulate the front of a vehicle. When the side arms are disposed in the latter position, the toy can be folded into a compact configuration simulating a vehicle such as an all terrain vehicle. A toy doll can be placed on top of the toy when it simulates a vehicle and used in conjunction with handles extending from the side arms.

The various features of the present invention will be best understood, together with further objects and advantages by reference to the following description of the preferred embodiment, taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
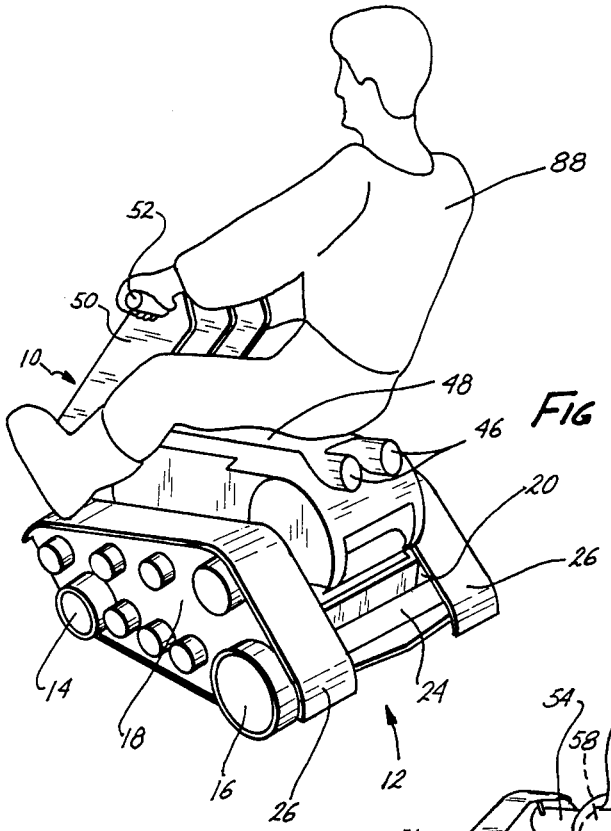
FIG. 1 is a perspective view of the preferred embodiment of the toy of the present invention showing how the toy can be used in conjunction with a toy doll when simulating a vehicle.
Figure 2:
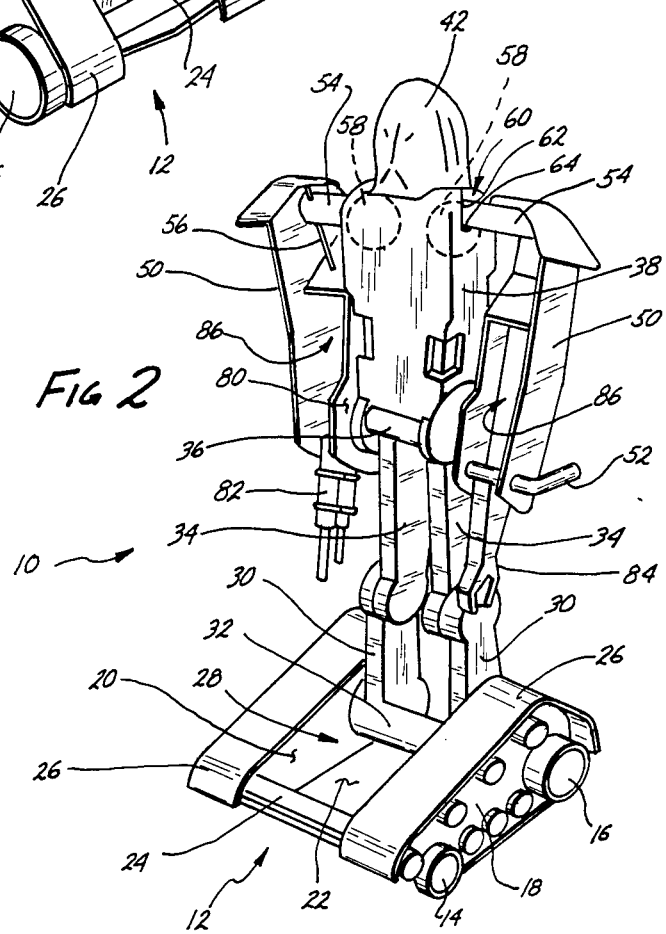
FIG. 2 is a perspective view of the preferred embodiment of the toy of the present invention showing the toy simulating a robot.

Referring now to the drawings and particularly to FIGS. 1 and 2, a preferred embodiment of the toy 10 of the present invention is disclosed. The toy 10 is supported on a base 12 having wheels 14 and 16 rotatably coupled to each of its sides 18 and 20. The base 12 is supported by the wheels 14 and 16 which allow the toy 10 to be rolled over a supporting surface. The sides 18 and 20 are attached to a flat bottom member 22 (see FIG. 2) and extend upwardly from the member. Strut members 24 (see FIG. 2) furnish additional rigidity and support for the base 12. The sides 18 and 20, bottom member 22 and strut members 24 combine to form a compartment 28 as shown in FIG. 2. Each of sides 18 and 20 preferably has simulated tank-like threads attached to it. Simulated thread guards 26 are also preferably attached to sides 18 and 20.

Figure 4:
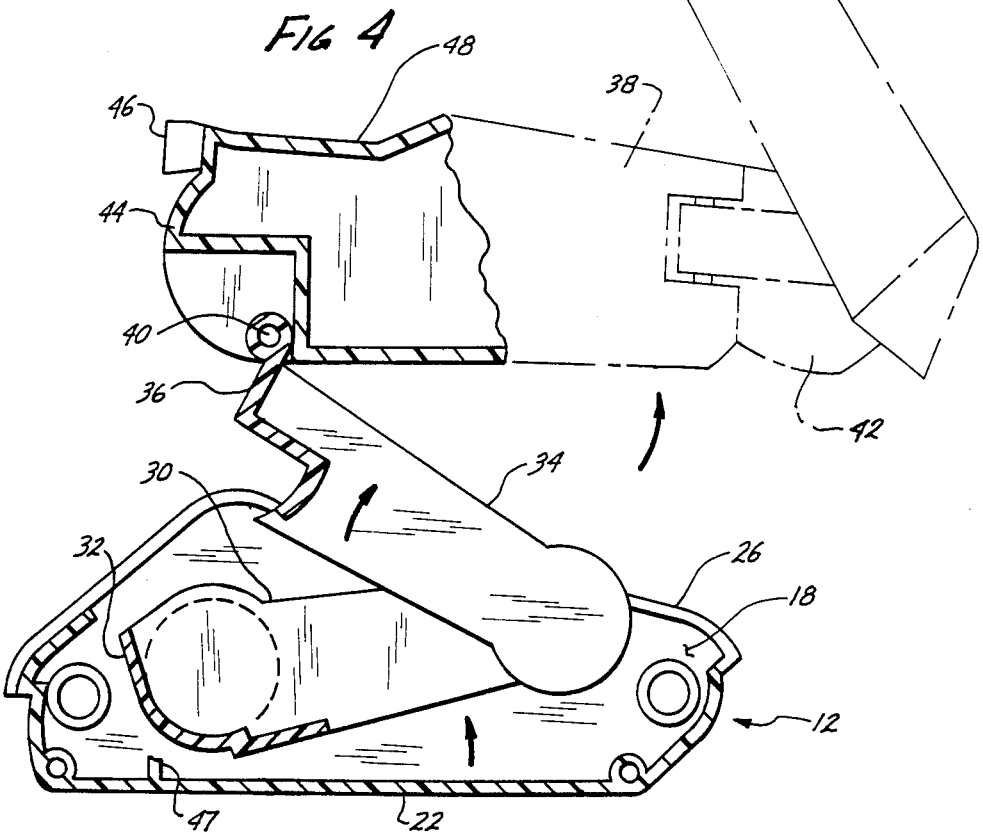
FIG. 4 is a partial logitudinal cross-section view of the preferred embodiment of the toy showing how the parts of the toy may be moved with respect to each other.
Figure 6:
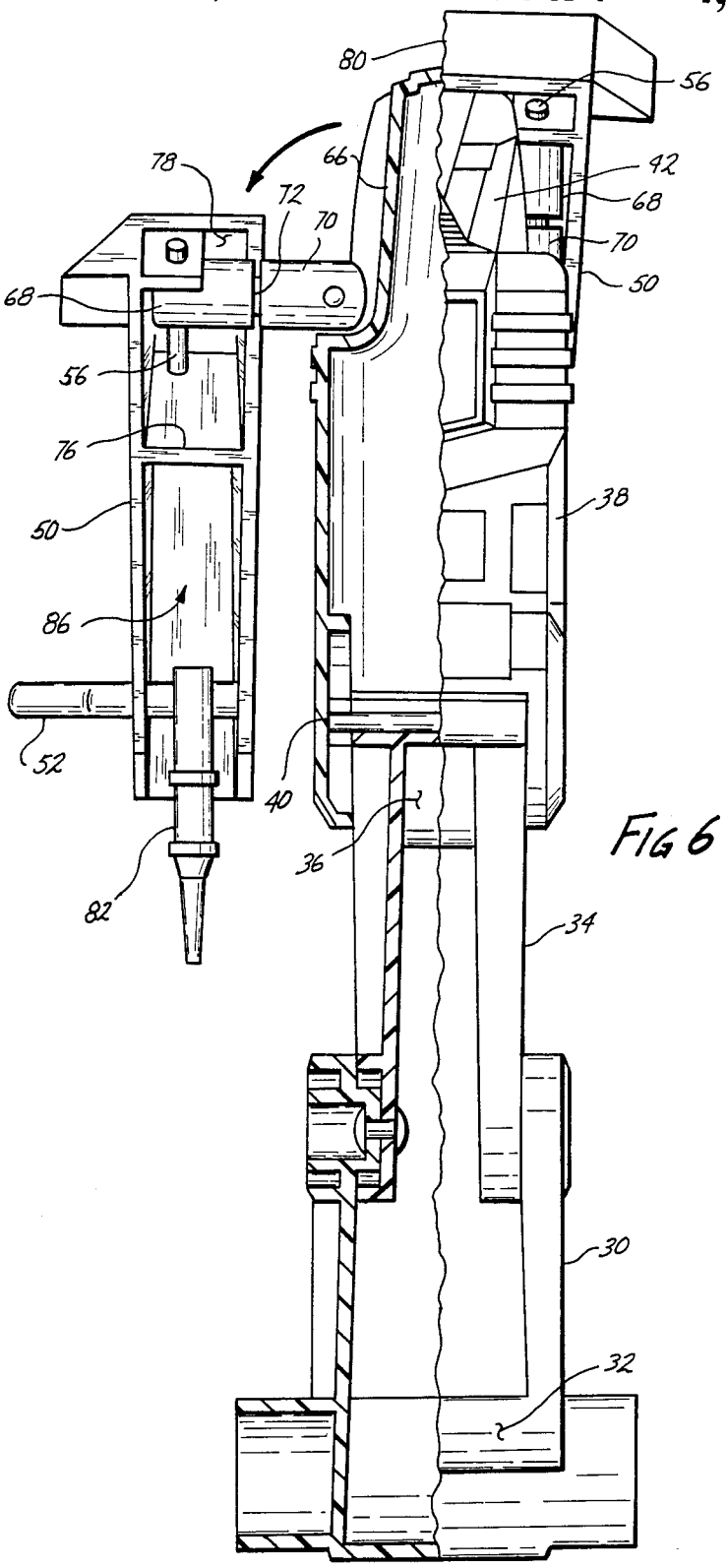
FIG. 6 is a partial longitudinal cross-section view of the toy as shown in FIG. 2 taken at a ninety degree angle from the cross-sectional view shown in FIG. 5.

As shown in FIGS. 2 and 4, the ends of two lower leg members 30 are rotatably coupled to sides 18 and 20. Note that the lower leg members 30 are joined together by support member 32 as shown in FIG. 2. The other ends of the lower leg members 30 are rotatably coupled to the ends of upper leg members 34. A coupling member 36 is attached to the other ends of the upper leg members 34. A torso member 38 is rotatably coupled to the coupling member 36 at point 40. The torso member 38 has a head portion 42 extending from one end. The torso member 38 and head portion 42 simulate the upper body of a robotic or humanoid configuration as shown in FIGS. 2 and 6. As such, the words robotic humanoid as used herein refer to either robotic or humanoid features, or both.

Figure 3:
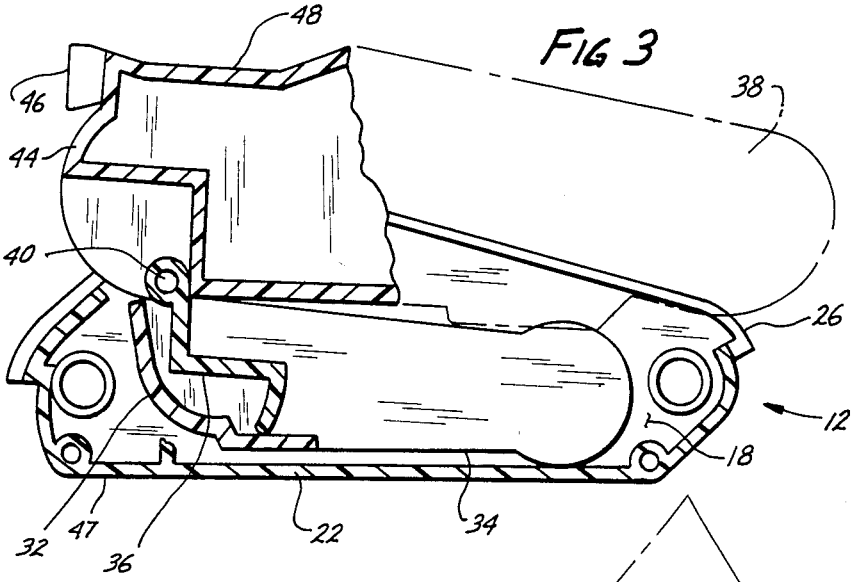
FIG. 3 is a partial longitudinal cross-section view of the toy as shown in FIG. 1.
Figure 5:
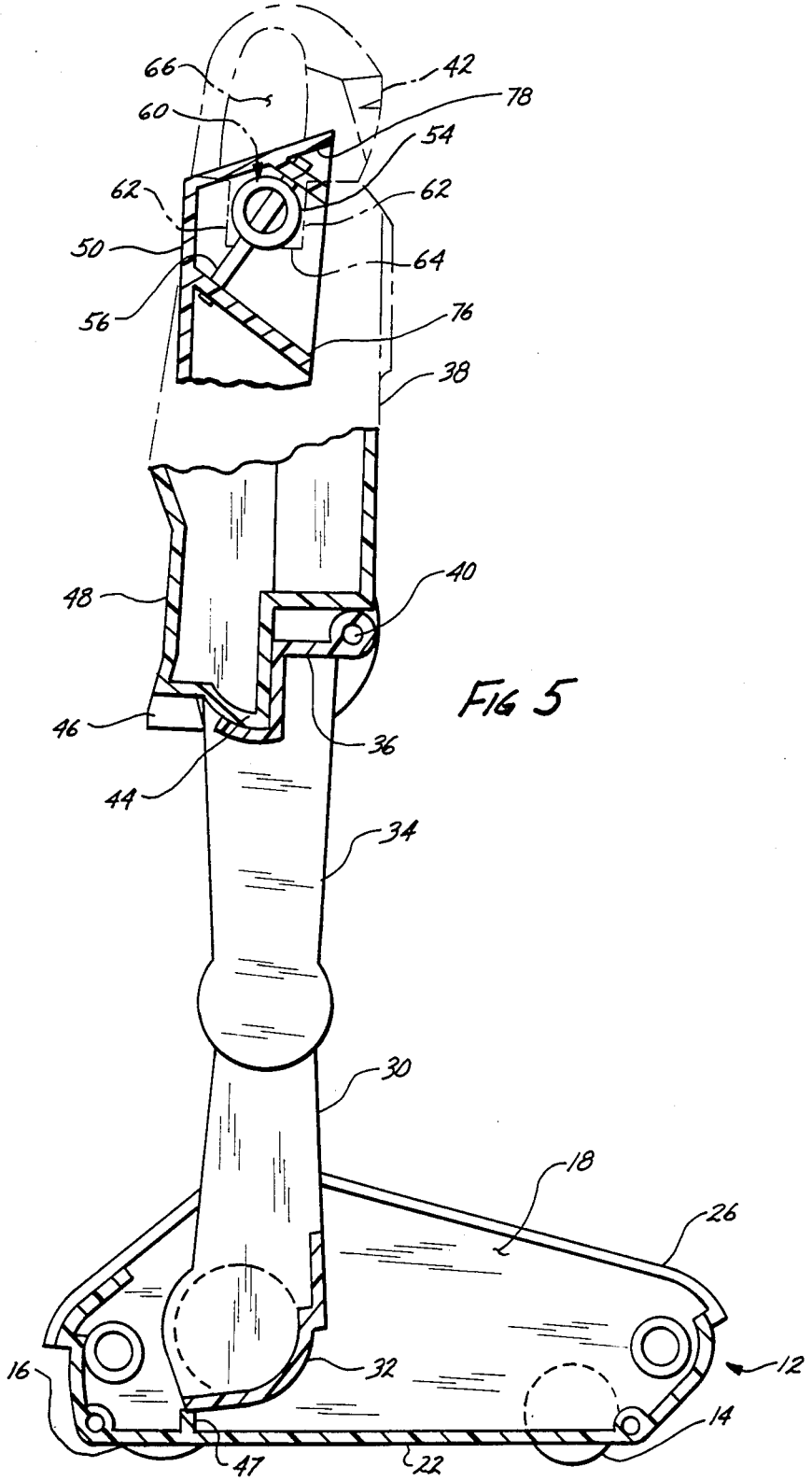
FIG. 5 is a partial longitudinal cross-section view of the toy as shown is FIG. 2.

As best shown in FIG. 4, the lower leg members 30, upper leg members 34 and torso member 38 can be moved or rotated with respect to each other in the direction of the shown arrows. As a result, the toy 10 can be folded into a compact configuration as shown in FIGS. 1 and 3 with members 30 and 34 conveniently disposed in compartment 28 in order to simulate a vehicle. In addition, the toy 10 can be extended (unfolded) until the members 30, 34 and 38 are in a generally vertical position as shown in FIGS. 2, 5 and 6. In this position, the configuration of the toy 10 simulates a robot. It is important to note that different types of coupling means may be used to rotatably couple the members 30, 34 and 38 to each other and members 30 to sides 18 and 20. This includes coupling means which would allow the members 30, 34 and 38 to be locked in a position other than a vertical position without collapsing and then unlocked and moved to another position. For example, the members 30, 34 and 38 may be locked in a position simulating a robot leaning forward in a stalking or semi-crouch position. The coupling means may then be unlocked and the members 30, 34 and 38 repositioned.

Note that an angled extension 44 removably engages the coupling member 36 as shown in FIG. 5 in order to provide support for the torso member 38 and limit its rotation. Also, bottom member 22 has an upwardly extending stop 47 which limits the rotation of the lower leg members 30 by engaging the support member 32. The torso member 38 preferably has dual extensions 46 at one end simulating exhaust pipes for a vehicle (see FIG. 1). In addition, the torso member 38 has a generally concave surface 48 on one side. The surface 48 is disposed on top of the toy 10 when it is positioned to simulate a vehicle as shown in FIGS. 1 and 3.

As shown in FIGS. 2, 4, 5 and 6, the torso member 38 has two side arms 50 operably coupled to it. The side arms 50 can be positioned as shown in FIGS. 2 and 6 to simulate the arms of a robot. In addition, the side arms 50 can be positioned as shown in FIGS. 1 and 4 to simulate the upper, front portion of a vehicle having handles 52. Note that each side arm 50 has a handle 52.

The side arms 50 are preferably coupled to the torso member 38 as shown in FIG. 2 by cylindrical members 54 which are rotatably coupled at one end to rods 56 attached to the side arms 50 (see FIG. 5). The other end of each cylindrical member 54 is attached to a ball joint 58 (shown by dashed lines in FIG. 2)located within the torso member 38. As such, the side arms 50 are free to rotate 360 degrees about the longitudinal axes of the cylindrical members 54. Slots 60 preferably exist on each side of the torso member 38 and attach to the ball joints 58. As a result, movement of the cylindrical members 54 is restricted by sides 62 and bottom 64 (see FIGS. 2 and 5) of each slot 60. In addition, movement of the cylindrical members 54 is further restricted by grooved surfaces 66 (see FIGS. 5 and 6) on each side of the head portion 42. As such, each cylindrical member 54 is free to rotate from the bottom 64 of the slot 60 until it comes into contact with the grooved surface 66. It is important to note that the configurations of the slots 60 and grooved surfaces 66 can be varied to increase or decrease the range of rotation of the cylindrical members 54 as desired.

FIG. 6 shows another method of rotatably coupling the side arms 50 to the torso members 38. Instead of using the cylindrical member 54, each side arm has two shorter cylindrical members 68 and 70 rotatably coupled to each other at point 72. Members 68 are rotatably coupled to rods 56 attached to the side arms 50 and members 70 are rotatably coupled to the torso member 38 at points 74 as shown in FIG. 6. Since the shorter cylindrical members 68 and 70 are rotatably coupled to each other, the side arms 50 can be rotated 360 degrees about the longitudinal axes of members 68 and 70. In addition, since members 70 are rotatably coupled to the torso member 38 at points 74, each member 70 is free to rotate from bottom 64 until it comes into contact with grooved surface 66. This allows each side arm to be positioned adjacent the head portion 42 as shown in FIGS. 4 and 6 (see right side of view shown in FIG. 6). When in this position, edge 76 and inside surface 78 (see FIGS. 5 and 6) of each side arm 50 rest on the back and top of the head portion 42, respectively. Note that the side arms 50 can be positioned in a similar manner when ball joints 58 are used. Surfaces 80 (see FIGS. 2 and 6) of each side arm 50 are preferably removably snapped together when the side arms 50 are positioned as shown in FIG. 4. Any means of the snapping the surfaces 80 together may be used.

When the side arms 50 are disposed adjacent the head position 42 as shown in FIG. 4 and the toy 10 is folded into a compact configuration as shown in FIG. 1, the side arms 50 simulate the front end of a vehicle. Handles 52 are rotatably coupled to each side arm 50. Attached to the handles 52 are members 82 and 84 representing simulated guns and a simulated hand, respectively. When the toy 10 simulates a robot, the members 82 and 84 may be rotated downward as shown in FIGS. 2 and 6 to give the appearance of a robot with guns and a hand. Note that other simulated objects other than guns or a hand may be used if desired. Also, members 82 and 84 can be fit inside compartments 86 (see FIGS. 2 and 6) of the side arms 50 by simply rotating the handles 52. Thus, the members 82 and 84 can be conveniently hidden out of sight when the side arms 50 are positioned adjacent the head portion 42. This is particularly advantageous when the toy 10 is used to simulate a vehicle. In such a case, only the handles 52 are showing helping to simulate the front end of a vehicle such as an all terrain vehicle as shown in FIG. 1.

The present invention is advantageous because the toy 10 when simulating a vehicle can be used in conjunction with a toy doll 88 as shown in FIG. 1. As illustrated, the toy doll 88 can be easily placed (seated) on top of the generally concave surface 48 while the hands of the doll may be used in conjunction with the handles 52. This furnishes additional play options for a child leading to increased enjoyment of the toy 10.

The various parts of the toy 10 are preferably molded out of plastic material. However, any other suitable material or method of fabrication may be used.

The above description discloses the preferred embodiment of the present invention. However, persons of ordinary skill in the toy field are capable of numerous modifications once taught these principles. Accordingly, it will be understood by those skilled in the art that changes in form and details may be made without departing from the spirit and scope of the invention.

We claim:

1. A toy comprising:

a base member having two sides and a bottom forming a compartment;

lower leg members each having one end thereof rotatably coupled to one of said two sides;

upper leg members each having one end thereof rotatably coupled to the other end of one of said lower leg members, said lower and upper leg members capable of being rotated and moved to a position within said compartment;

a torso member simulating a robotic humanoid head and trunk rotatably coupled to the other end of each of said upper leg members; and side arm means operably coupled to said torso member for selective simulating a pair of arms for said robotic humanoid head and trunk and a front end of a vehicle.

2. The toy of claim 1 further comprising wheels rotatably coupled to said base member, said wheels supporting said toy.

3. The toy of claim 2 wherein said side arm means includes:

two side arms each having a rod attached at one end thereof and a handle with a simulating member rotatably coupled to the other end thereof; and two cylindrical members, each of said two cylindrical members being rotatably coupled to said torso member and to one of said rods attached to one of said two side arms.

4. The toy of claim 3 wherein said two cylindrical members are rotatably coupled to said torso member by ball joints.

5. The toy of claim 2 wherein said side arm means includes:

two side arms each having a rod attached at one end thereof and a handle with a simulating member rotatably coupled to the other end thereof;

a first pair of cylindrical members, each of said first pair of cylindrical members being rotatably coupled to one of said rods attached to one of said two side arms; and a second pair of cylindrical members, each of said second pair of cylindrical members being rotatably coupled to one of said first pair of cylindrical members and to said torso member.

6. A toy for use in conjunction with a toy doll comprising:

a base member having two sides and a bottom forming a compartment and wheels rotatably coupled thereto;

lower leg members rotatably coupled to said base member;

upper leg members each having one end thereof rotatably coupled to one of said lower leg members, said lower and upper leg members capable of being rotated and moved to a position within said compartment;

a torso member simulating a robotic humanoid head and trunk rotatably coupled to the other end of each of said upper leg members, said torso member having a generally concave surface on one side thereof capable of supporting said toy doll; and side arm means operably coupled to said torso member for selectively simulating a pair of arms for said robotic humanoid head and trunk and a front end of a vehicle, said side arms capable of being positioned adjacent one end of said torso member in order to simulate said vehicle and capable of hanging vertically from said torso member in order to simulate said pair of arms.

7. The toy of claim 6 wherein said side arm means includes:

two side arms each having a rod attached at one end thereof and a handle with a simulating member rotatably coupled to the other end thereof, each of said handles capable of operably engaging and providing support for said toy doll; and two cylindrical members, each of said two cylindrical members being rotatably coupled to said torso member and to one of said rods attached to one of said two side arms.

8. The toy of claim 7 wherein said two cylindrical members are rotatably coupled to said torso member by ball joints.

9. The toy of claim 6 wherein said side arm means includes:

two side arms each having a rod attached at one end thereof and a handle with a simulating member rotatably coupled to the other end thereof, each of said handles capable of operably engaging and providing support for said toy doll;

a first pair of cylindrical members, each of said first pair of cylindrical members being rotatably coupled to one of said rods attached to one of said two side arms; and a second pair of cylindrical members, each of said second pair of cylindrical members being rotatably coupled to one of said first pair of cylindrical members and to said torso member.

10. A toy for use in conjunction with a toy doll which can be used to simulate a robot and a vehicle comprising:

a base member having a bottom, two sides extending upward from said bottom and supporting members attached to said bottom and said two sides, said bottom, said two sides and said supporting members forming a compartment;

wheels rotatably coupled to said two sides, said wheels operably engaging a supporting surface;

two lower leg members, each of said two lower leg members having one end thereof rotatably coupled to one of said two sides;

two upper leg members, each of said two upper leg members having one end thereof rotatably coupled to the other end of one of said lower leg members, said lower and upper leg members capable of being rotated and moved to a position within said compartment;

a torso member simulating a robotic humanoid head and trunk rotatably coupled to the other end of each of said upper leg members, said torso member having a generally concave surface on one side thereof capable of supporting said toy doll;

two side arms operably coupled to said torso member each having a rod attached at one end thereof and a handle with a simulating member rotatably coupled to the other end thereof, each of said handles capable of operably engaging and providing support for said toy doll; and means for operably coupling said two side arms to said torso member in order to selectively simulate a pair of arms for said robotic humanoid head and trunk and a front end of a vehicle.

11. The toy of claim 10 wherein said means for coupling said two side arms includes two cylindrical members and two ball joints attached to said cylindrical members, each of said two cylindrical members being rotatably coupled to one of said rods attached to one of said two side arms.

12. The toy of claim 10 wherein said means for coupling said two side arms includes:

a first pair of cylindrical members, each of said first pair of cylindrical members being rotatably coupled to one of said rods attached to one of said two side arms; and a second pair of cylindrical members, each of said second pair of cylindrical members being rotatably coupled to one of said first pair of cylindrical members and to said torso member.

* * * * *